US005604934A

United States Patent [19]

Willett

[11] Patent Number: 5,604,934

[45] Date of Patent: Feb. 25, 1997

[54] ATHLETIC GLOVE FOR BAT, CLUB AND RACQUET SPORTS

[75] Inventor: Fred L. Willett, Winston-Salem, N.C.

[73] Assignee: Sandlot Sports, Inc., Advance, N.C.

[21] Appl. No.: 533,062

[22] Filed: Sep. 25, 1995

Related U.S. Application Data

[63] Continuation-in-part of Ser. No. 216,914, Mar. 23, 1994, abandoned.

[51] Int. Cl.[6] ..... A41D 19/00

[52] U.S. Cl. ..... 2/161.1; 2/161.2

[58] Field of Search ..... 2/16, 159, 160, 2/161.1, 161.2, 161.3, 161.4, 20

[56] References Cited

U.S. PATENT DOCUMENTS

| | | | |
|---|---|---|---|
| 3,922,724 | 12/1975 | Shockovsky | 2/161.2 |
| 4,187,557 | 2/1980 | Tombari . | |
| 4,329,741 | 5/1982 | Bach . | |
| 4,461,043 | 7/1984 | Lomedico . | |
| 4,525,877 | 7/1985 | Chong . | |
| 4,561,122 | 12/1985 | Stanley et al. . | |
| 4,691,387 | 9/1987 | Lopez . | |
| 5,168,578 | 12/1992 | Stanley . | |
| 5,218,719 | 6/1993 | Johnson . | |
| 5,257,418 | 11/1993 | Jaskiewicz | 2/20 |

*Primary Examiner*—Michael A. Neas
*Attorney, Agent, or Firm*—Shefte, Pinckney & Sawyer

[57] ABSTRACT

An athletic glove to be worn by baseball batters (as well as other participants in bat, club and racquet sports) promotes proper gripping disposition of the handle portion of a baseball bat by providing a spacing member integrally airfixed to the crotch area of the palm of the glove body for engagement with the handle portion of the bat when gripped in the batter's hand so as to maintain the handle portion at a spacing from the palm of the hand and induce the batter to cradle the handle portion within the fingers.

6 Claims, 4 Drawing Sheets

ATHLETIC GLOVE FOR BAT, CLUB AND RACQUET SPORTS

REFERENCE TO RELATED APPLICATION

This is a continuation-in-part of U.S. application Ser. No. 08/216,914, filed Mar. 23, 1994, entitled "Athletic Glove for Bat, Club and Racquet Sports", now abandoned.

BACKGROUND OF THE INVENTION

The present invention relates generally to athletic gloves and, more particularly, to gloves of the type used by baseball batters, golfers, tennis and racquetball players, and similar participants in other bat, club and racquet sports.

Gloves are commonly worn by athletes participating in various sports, particularly bat, club and racquet sports, to enhance the participant's grip. For example, for many years, baseball players have commonly worn specially designed thin leather gloves while batting to improve and enhance the batter's grip on the bat handle and, in turn, to optimize the batter's power and control in swinging the bat.

Conventional wisdom holds that the optimal gripping disposition of the baseball bat handle within a batter's hands is to allow the handle to be cradled loosely within the fingers in contact with the heel of the hand but otherwise at a spacing from the batter's palms so that the middle, ring and small fingers of the hands are used to exert the principal gripping force on the handle rather than the batter's forefingers and thumbs.

Unfortunately, the natural tendency of most baseball players is to hold the bat handle with a significant gripping force with the handle firmly pressed into the palms of the hands and into the crotch region between the thumb and forefinger of each hand. However, rather than improving the batter's power and control, this improper gripping technique causes the muscles in the batter's wrist and forearms to be tensioned and therefore detracts from the batter's ability to exert optimal force when swinging the bat. Also, the disposition of the bat handle against the batter's palms, together with the tension exerted in the wrists and forearms, resists the tendency of the batter's upper hand to turn or "roll over" the lower hand as the swing is completed, which is considered to be necessary and desirable to optimize the traveling speed of the bat at its outer hitting end.

SUMMARY OF THE INVENTION

It is accordingly an object of the present invention to provide an improved athletic glove for use by players in bat, club and racquet sports which is configured to induce the player to grip the handle of the bat, club or racquet in optimal disposition within the fingers of the player's hands rather than pressed against the palms of the hands.

Briefly summarized, in its most basic aspect, the glove of the present invention comprises a main glove body having a palm portion to overlay the palm of the athlete's hand when worn and a spacing member integrally affixed to the palm portion of the glove body for engagement with the handle portion of the bat, club or racquet when gripped in the athlete's hand. In this manner, the handle portion is maintained at a spacing from the palm of the hand so as to induce the athlete to cradle the handle portion within the fingers of the hand.

In the preferred embodiment adapted particularly for use by baseball batters in gripping the handle of a baseball bat, the glove body defines an interior hand receiving area for the batter's hand, a wrist opening for insertion of the hand into the interior area, and a plurality of tubular portions defining thumb and finger openings for receiving respectively the thumb and fingers of the batter's hand.

The palm portion of the main glove body includes a crotch area for overlaying a crotch region of the batter's palm between the thumb and forefinger and a heel area for overlaying a heel region of the batter's palm adjacent the wrist. The spacing member, preferably in the form of a pad, is affixed to the palm portion substantially only in the crotch area of the glove body, thereby terminating at a sufficient spacing from the heel area to maintain the handle portion of the bat spaced from the crotch region of the batter's palm while permitting the handle portion to rest against the heel area of the batter's hand for maximizing the gripping force exerted on the handle portion by the batter's middle, ring and small fingers.

In an alternate embodiment, a secondary spacing member may be affixed to the tubular portion for the forefinger of the batter's hand immediately adjacent the inward knuckle to also maintain the handle portion of the bat spaced from the batter's forefinger.

DESCRIPTION OF THE PREFERRED EMBODIMENT

Figure 1:
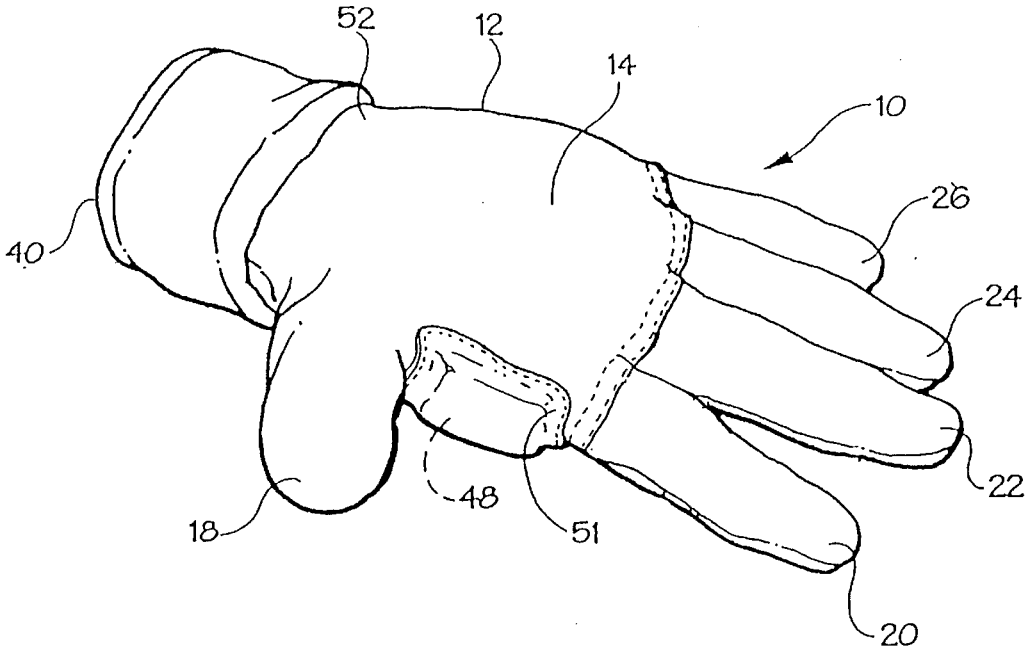
FIG. 1 is a perspective view of the palm side of a baseball batting glove according to the preferred embodiment of the present invention.
Figure 2:
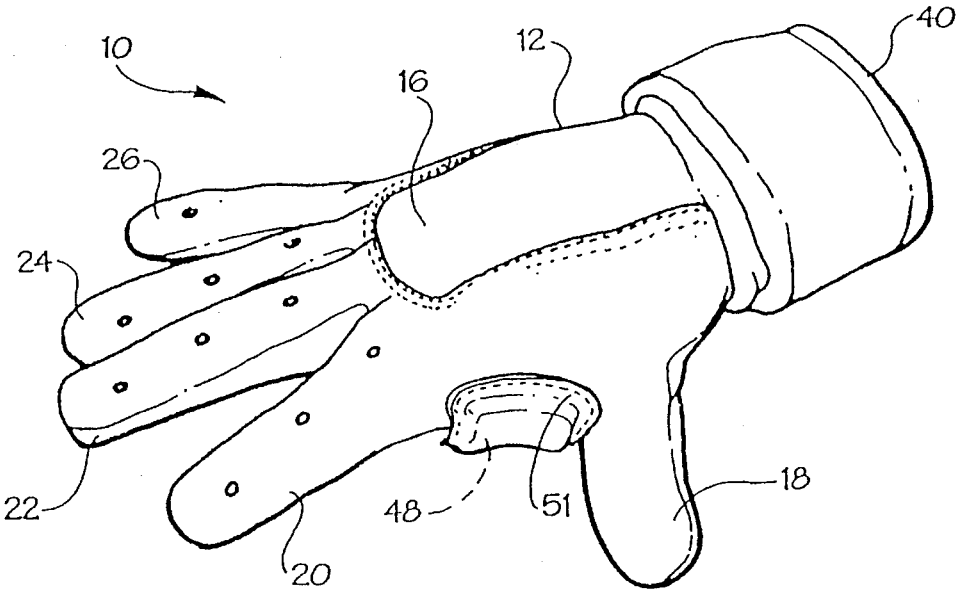
FIG. 2 is a perspective view of the backhand side of the baseball glove of FIG. 1.

Referring now to the accompanying drawings and initially to FIGS. 1 and 2, a baseball batting glove according to the preferred embodiment of the present invention is indicated generally at 10. The glove 10 is preferably fabricated from relatively thin tanned leather, a textile fabric material, or a combination thereof, such as the materials from which conventional batting gloves are constructed.

The batting glove 10 comprises a main glove body 12 having a palm portion 14 and a backhand portion 16 with individual tubular thumb, forefinger, middle finger, ring finger, and little finger portions 18,20,22,24,26, respectively, sewn or otherwise secured together to provide an interior hand pocket with individual thumb and finger pockets, respectively.

The palm and backhand portions 14,16 define a wrist opening 40 for insertion of a batter's hand into the interior hand pocket. A wristband 42 encircles the wrist opening 40 and comprises mating closures (not shown), typically hook-and-loop fastener components such as Velcro closure components, to selectively enlarge and close the wrist opening 40 for the wearer's ease in inserting and removing the hand into and from the hand pocket and securing the glove 10 snugly on the hand during wearing. Those persons knowledgeable in the art will recognize and understand that the wristband 42 is optional and that the present invention is equally adaptable to gloves having no such wristband 42.

Figure 3:
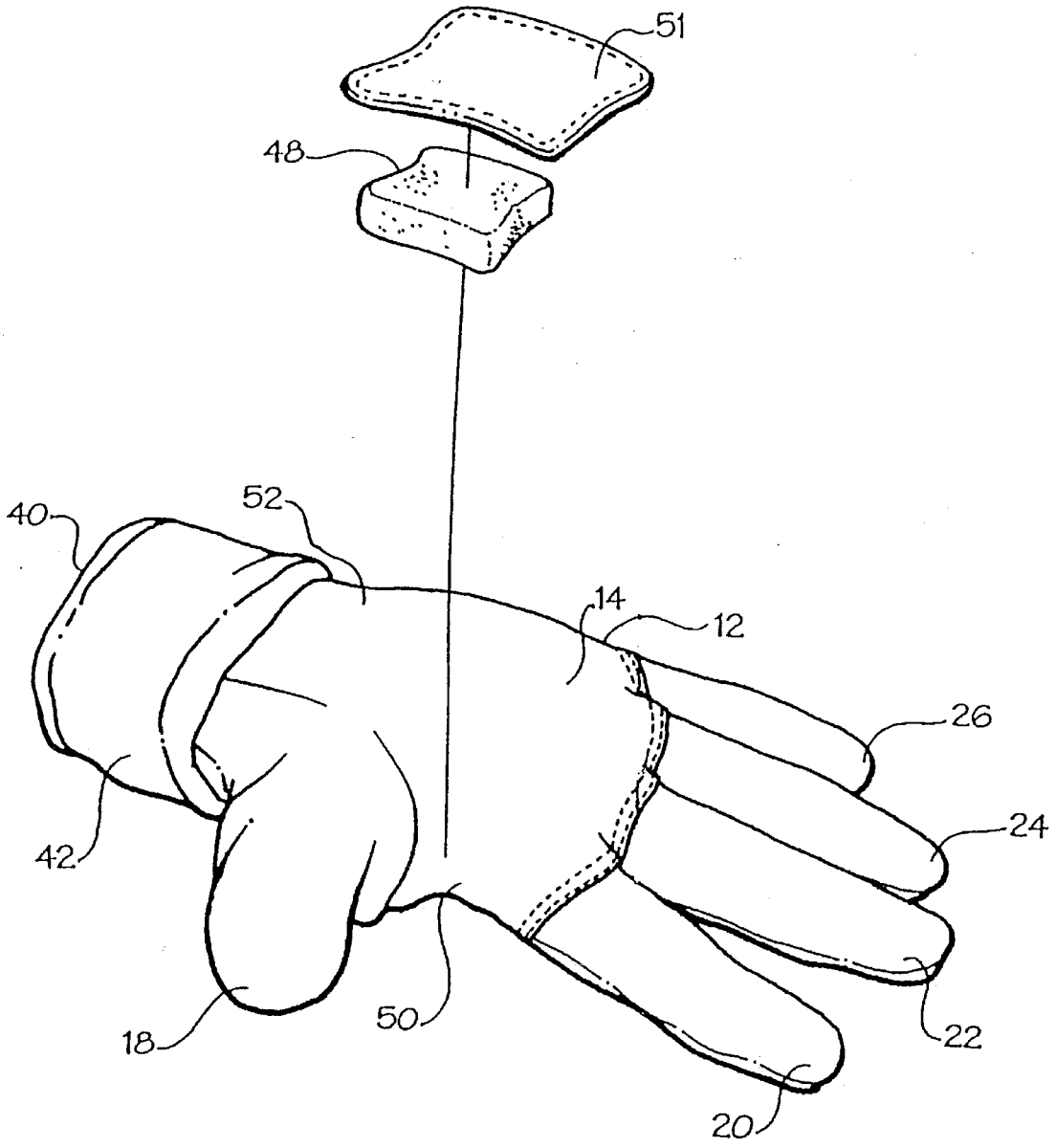
FIG. 3 is an exploded perspective view of the glove of FIG. 1.

In accordance with the present invention, a spacing member 48 (FIG. 3) of a generally rectangular shape is affixed to the palm portion 14 of the glove body 12 in the crotch region 50 spanning the area between the thumb and forefinger portions 18,20 and extends a short distance therefrom across the palm portion 14, terminating short of the center of the palm portion 14 and therefore at a substantial spacing from the opposite heel region 52 of the palm portion 14 adjacent the wrist opening 40. The opposite sides of the spacing member 48 adjacent the thumb and forefinger portions 18,20 may be slightly concave in shape to conform to the base of the wearer's thumb and forefinger when curled with the other fingers of the hand into a bat gripping disposition. A rectangular leather patch 51 is sewn to the palm portion 14 and partially overlapping to the backhand portion 16, in covering relation to the spacing member 48 to secure it in place in its described disposition.

The spacing member 48 preferably is in the form of a pad having a sufficient degree of compressibility and resiliency to provide a comfortable feel to the wearer's palm but being sufficiently firm to resist substantial compression under the normal gripping forces exerted by a baseball batter's hands. For this purpose, the pad may preferably be fabricated of various conventional resilient foam materials.

Figure 4:
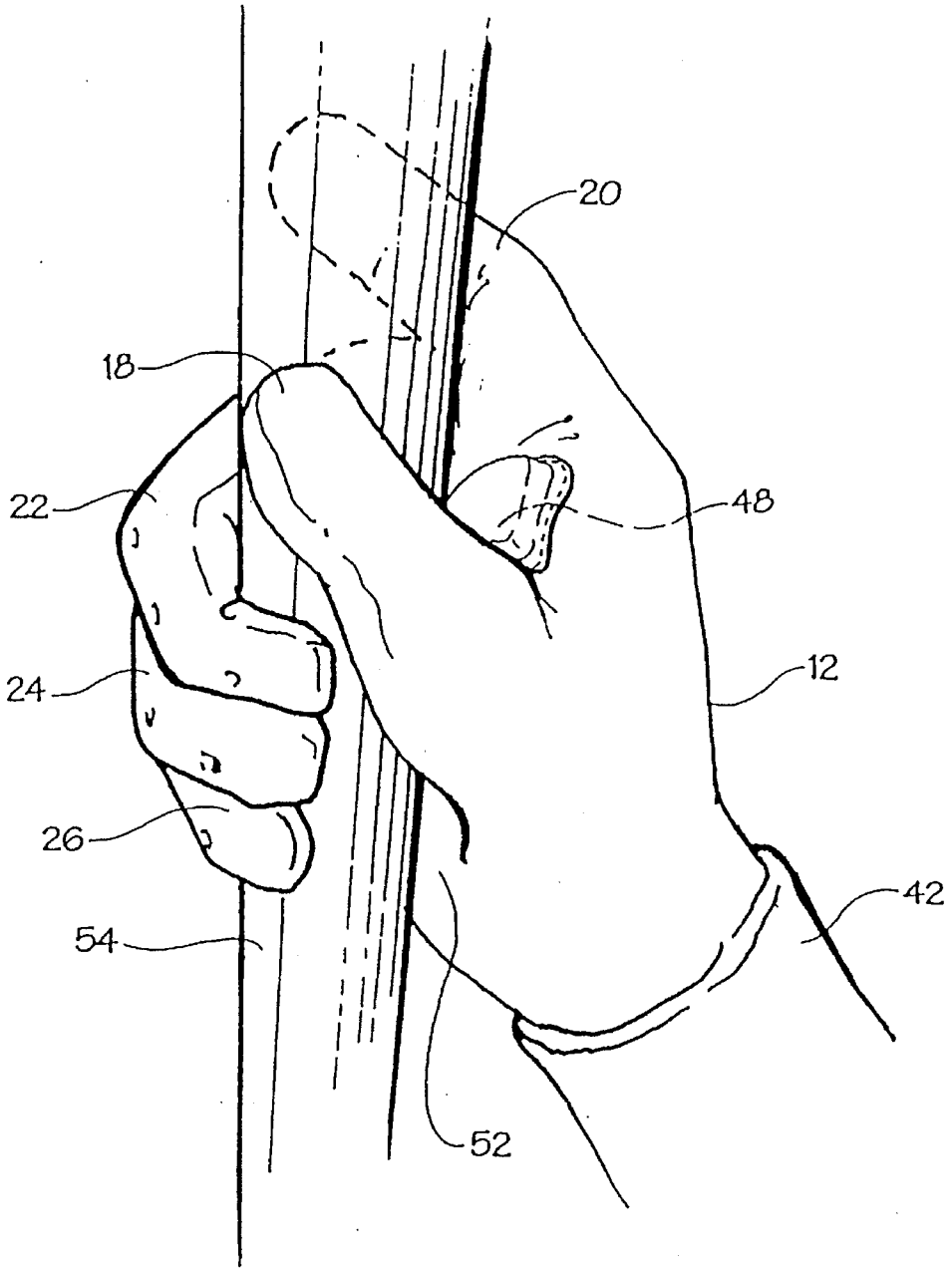
FIG. 4 is a diagrammatic view of a baseball batter's hand gripping the handle portion of a baseball bat while wearing the glove of the present invention.

The use and function of the batting glove of the present invention may thus be understood with particular reference to FIG. 4. In FIG. 4, one hand of a baseball batter is shown to be in gripping disposition with the handle portion 54 of a conventional baseball bat, while the hand is wearing a glove 10 in accordance with the present invention. Of course, although FIG. 4 depicts only one hand of the batter, it will be understood that the optimal benefits of the present invention will be realized by wearing a glove of the invention on each hand while batting. As will be seen, the padded spacing member 48, being located substantially only in the crotch region 50 of the palm portion 14, serves to maintain a spacing between the handle portion 14 and the wearer's palm underlying the crotch region 50, while the termination of the spacing member 48 at a distance away from the heel region 52 allows the handle portion 54 to rest against the underlying heel of the batter's hand. In this manner, the batter is induced and constrained to cradle the handle portion within the fingers of the hand and to utilize the middle, ring and small fingers to exert the principal gripping force on the handle portion 54. In turn, the batter's wrist and forearm will naturally remain relatively relaxed. Since the batter is thereby caused to hold the handle portion 54 in the optimal griping disposition according to conventional teachings, the batter is enabled to exert an optimal swinging force on the handle portion 54 of the bat through the batter's wrist and forearm muscles and to achieve an optimal "rollover" of the upper hand at the completion of the swing so as to maximize the traveling speed of the outer hitting end of the bat.

An additional, but equally if not more important, advantage of the batting glove of the present invention is that, unlike substantially all prior art gloves having any form of grip-altering means, the glove of the present invention does not create an unnatural feel to the wearer when gripping a bat. On the contrary, because of the precise location of the padded spacing member 48 substantially only in the crotch region 50 of the palm portion 14 of the glove, the bat rests in the fingers and against the heel of the hands, which is the most natural manner of gripping a bat for most players, thereby creating an entirely natural feel when wearing the present glove. Within these natural gripping areas of the hands, i.e., within the fingers, the palm and the heel of the hands, the glove of the present invention includes no additonal pad or other "foreign" device which would alter the natural feel of the wearer in gripping a bat. Rather than altering a player's natural feel in gripping a bat, the spacing member 48 essentially only prevents a batter from consciously or subconsciously departing from such natural gripping style by forcing the bat handle into the crotch areas of the hands.

Figure 5:
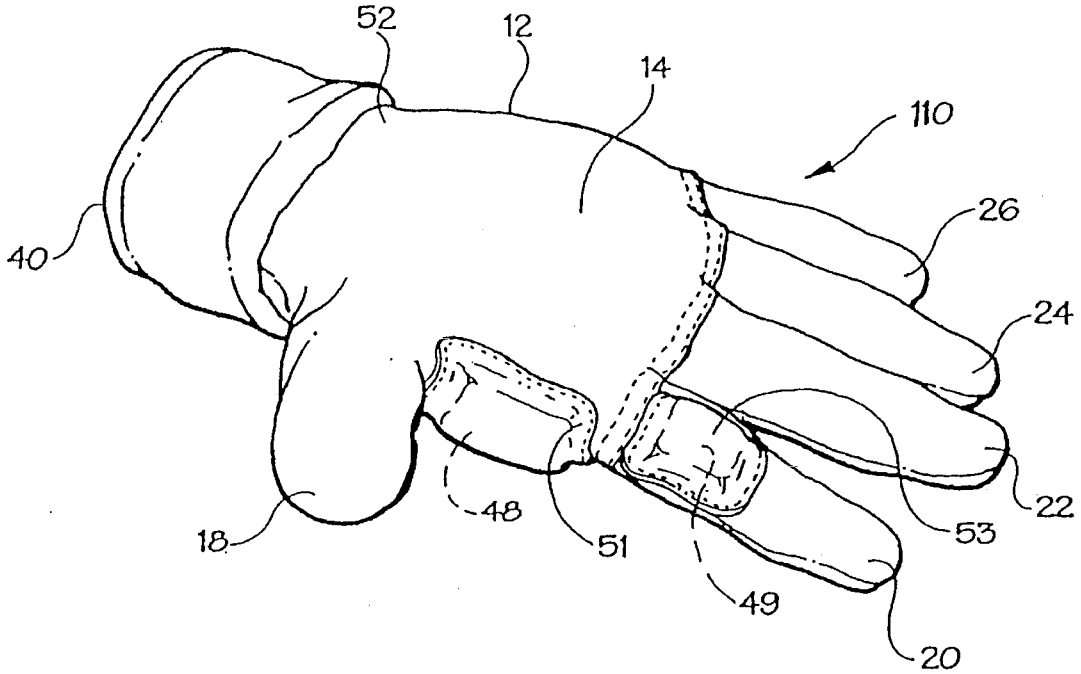
FIG. 5 is a perspective view like FIG. 1 showing an alternative embodiment of a baseball batting glove.

In FIG. 5, an alternative embodiment of batting glove 110 is shown, the glove 110 being substantially identical to the glove 10 of FIGS. 1–4 except that, in addition to the spacing member 48, a second spacing member 49 of a generally rectangular or oblong shape is affixed to the palm side of the forefinger portion 20 immediately adjacent the palm portion 14, the spacing member 49 being of a sufficiently abbreviated length to terminate short of the first knuckle of the wearer's hand. Likewise another rectangular patch 53 is sewn to the forefinger portion 20 to cover and secure the spacing member 49 in place. As will be understood, by the placement of the spacing members 48,49 of the glove 110 only in the crotch region 50 and on the base of the forefinger portion 20, a hitter is similarly constrained to grip a baseball bat in the fingers of the hand, leaving the muscles of the arm relaxed for optimal swinging force and wrist "rollover."

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. For example, persons skilled in the art will recognize that the glove of the present invention is equally adapted to embodiments for use by golfers, tennis and racquetball players, and other athletes participating in similar bat, club or racquet sports and the like wherein a sports implement or accessory is swung while gripped in the participant's hand. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. An athletic glove to be worn on a hand by a participant in bat, club or racquet sports to promote proper gripping disposition of a handle portion of a bat, club or racquet within the participant's hand, the glove comprising a main glove body having a palm portion to overlay the palm of the participant's hand when worn and spacing means integrally affixed to the palm portion of the glove body for engagement with the handle portion of a bat, club or racquet when gripped in the participant's hand to maintain the handle portion at a spacing from the palm of the hand and to induce the participant to cradle the handle portion within the fingers of the hand, the palm portion of the main glove body including a crotch area for overlaying a crotch region of the participant's palm between the thumb and forefinger, and said spacing means including a spacing member disposed only in said crotch area of said glove body located between the respective junctions of the thumb and forefinger with the hand to maintain the handle portion of the bat, club or racquet spaced from the crotch region of the participant's palm, other than said primary spacing member, said palm portion being free of spacing members.

2. An athletic glove according to claim 1, wherein the palm portion of the main glove body includes a heel area for overlaying a heel region of the participant's palm adjacent the wrist, the spacing member in the crotch area terminating at a sufficient spacing from the heel area to permit the handle portion of the bat, club or racquet to rest against the heel area of the participant's hand for maximizing the gripping force exerted on the handle portion by the participant's middle, ring and small fingers.

3. An athletic glove according to claim 1, wherein the spacing member comprises a pad affixed to the crotch area of the palm portion of the glove body.

4. An athletic glove according to claim 1, wherein the glove body defines an interior hand receiving area for the participant's hand, a wrist opening for insertion of the hand into the interior area, and thumb and finger openings for receiving the thumb and fingers of the participant's hand.

5. An athletic glove according to claim 4, wherein the glove body includes a plurality of tubular portions for receiving respectively the thumb and fingers of the hand.

6. An athletic glove to be worn on a hand by a participant in bat, club or racquet sports to promote proper gripping disposition of a handle portion of a bat, club or racquet within the participant's hand, the glove comprising a main glove body having a palm portion to overlay the palm of the participant's hand when worn and a plurality of tubular portions for receiving respectively the thumb and fingers of the hand when worn, and spacing means integrally affixed to the palm portion of the glove body for engagement with the handle portion of a bat, club or racquet when gripped in the participant's hand to maintain the handle portion at a spacing from the palm of the hand and to induce the participant to cradle the handle portion within the fingers of the hand, the palm portion of the main glove body including a crotch area for overlaying a crotch region of the participant's palm between the thumb and forefinger, and said spacing means including a primary spacing member disposed only in said crotch area of said glove body located between the respective junctions of the thumb and forefinger with the hand and a secondary spacing member disposed only immediately adjacent the palm portion on the side of the forefinger tubular portion facing the palm portion and terminating at a location along the forefinger tubular portion short of the first knuckle of the forefinger to maintain the handle portion of the bat, club or racquet spaced from the crotch region of the participant's palm, other than said primary spacing member, said palm portion being free of spacing members.

* * * * *